US011491614B2

(12) United States Patent
Hsieh

(10) Patent No.: US 11,491,614 B2
(45) Date of Patent: Nov. 8, 2022

(54) RATCHET WRENCH ALLOWING EASY CHANGE OF ROTATION DIRECTION

(71) Applicant: KABO Tool Company, Taichung (TW)

(72) Inventor: Chih-Ching Hsieh, Taichung (TW)

(73) Assignee: KABO Tool Company, Taichung (TW)

( * ) Notice: Subject to any disclaimer, the term of this patent is extended or adjusted under 35 U.S.C. 154(b) by 0 days.

(21) Appl. No.: 17/249,424

(22) Filed: Mar. 2, 2021

(65) Prior Publication Data

US 2021/0331296 A1 Oct. 28, 2021

(30) Foreign Application Priority Data

Apr. 24, 2020 (TW) ..... 109113944

(51) Int. Cl.
*B25B 13/46* (2006.01)
*B25B 23/00* (2006.01)

(52) U.S. Cl.
CPC ..... *B25B 13/463* (2013.01); *B25B 23/0035* (2013.01)

(58) Field of Classification Search
CPC ..... B25B 13/463; B25B 23/0035
USPC ..... 81/63.1, 62, 63.2, 61
See application file for complete search history.

(56) References Cited

U.S. PATENT DOCUMENTS 4,589,307 A * 5/1986 Parker ..... B25B 13/463 81/62
4,967,624 A * 11/1990 Farris ..... B25B 13/463 81/63
2021/0060739 A1* 3/2021 Chiang ..... B25B 23/0035
2021/0060740 A1* 3/2021 Chiang ..... B25B 13/463

* cited by examiner

*Primary Examiner* — Hadi Shakeri
*Assistant Examiner* — Sarah Akyaa Fordjour
(74) *Attorney, Agent, or Firm* — Wang Law Firm, Inc.

(57) ABSTRACT

A ratchet wrench allowing easy change of rotation direction includes a main body, a ratchet gear, a pawl, a sideways pushing member, and a direction changing device. The main body has a shaft connected with a head portion. The head portion has a receiving chamber housing the ratchet gear, the pawl, and the sideways pushing member and connected to a channel in the shaft. The direction changing device has a rotating rod in the channel, a sideways pushing button for rotating the rotating rod, an engaging member at the rear end of the sideways pushing member, and an engaging groove at the front end of the rotating rod and engaged with the engaging member, which is axially offset from the rotating rod. The rotating rod can rotate the sideways pushing member and thereby displace the pawl so that a different portion of the pawl meshes with the ratchet gear.

10 Claims, 22 Drawing Sheets

RATCHET WRENCH ALLOWING EASY CHANGE OF ROTATION DIRECTION

BACKGROUND OF THE INVENTION

1. Technical Field

The present invention relates to a wrench and more particularly to a ratchet wrench whose rotation direction can be easily switched.

2. Description of Related Art

A ratchet wrench configured to be rotated in two directions has a direction switching button. The switching button can be switched between two positions in order to change the rotation direction of the ratchet gear of the ratchet wrench.

The switching button of a conventional ratchet wrench is provided at a head portion of the wrench and is therefore quite a distance from the handle of the wrench. When it is desired to change the rotation direction of the ratchet wrench, the user must operate the wrench with both hands, i.e., hold the handle with the one hand and operate the switching button with the other hand. It is difficult, if not impossible, to switch the rotation direction of the ratchet wrench single-handedly.

Moreover, when the ratchet wrench is used in a narrow space, e.g., when the head portion of the wrench is inserted deep into the narrow space (and hence extends away from the user) and coupled with a threaded fastener, the narrowness of the space may keep the user's hand from reaching the head portion through the space. In that case, the head portion of the ratchet wrench must be separated from the workpiece, and the wrench moved out of the narrow space, in order to switch the rotation direction of the ratchet gear of the wrench. Once the rotation direction is switched, the user will have to insert the wrench back into the narrow space and couple the head portion to the threaded fastener again. That is to say, the rotation direction of the ratchet wrench cannot be switched without moving the wrench out of the narrow space, which causes inconvenience of use.

BRIEF SUMMARY OF THE INVENTION

The present invention aims to solve the foregoing drawback of the prior art, the primary objective being to provide a ratchet wrench with a direction changing device that not only is configured to switch the rotation direction of the wrench, but also is provided in and partially exposed from the shaft of the wrench to enable convenient operation.

Another objective of the present invention is to provide the aforesaid ratchet wrench and dispose the direction changing device at a position relatively close to the gripping end of the ratchet wrench so that a user can switch the rotation direction of the ratchet gear of the ratchet wrench single-handedly.

Still another objective of the present invention is to provide a ratchet wrench that allows its rotation direction to be easily switched in a narrow space.

The present invention provides a ratchet wrench that allows easy change of rotation direction. The ratchet wrench includes a main body, a ratchet gear, a pawl, a sideways pushing member, and a direction changing device.

The main body has a shaft, a head portion connected to the front end of the shaft, a receiving chamber provided in the head portion, a channel provided in the shaft along the longitudinal direction of the main body and having a front end connected to the receiving chamber, and an open groove provided in the shaft and communicating with the channel.

The ratchet gear and the pawl are mounted in the receiving chamber of the head portion. The pawl has a front end face meshing with the periphery of the ratchet gear.

The sideways pushing member is rotatably mounted in the receiving chamber and is located behind the pawl. The sideways pushing member can drive the pawl into displacement when rotated.

The direction changing device has a sideways pushing button, a rotating rod, an engaging member, and an engaging groove configured to work with the engaging member.

The rotating rod is mounted in the channel of the main body and can be rotated in the channel. The rotating rod has a front end aligned with the sideways pushing member and a rear end reaching the open groove.

The sideways pushing button is connected to the rotating rod through the open groove and can drive the rotating rod into rotation.

The engaging member and the engaging groove are provided at a rear end face of the sideways pushing member and a front end face of the rotating rod respectively or vice versa. The free end of the engaging member is engaged in the engaging groove, and the center of the free end of the engaging member is offset from the central axis of the rotating rod. When rotated in different directions, the rotating rod can move the sideways pushing member in different directions and thereby displace the pawl toward two opposite lateral sides of the receiving chamber respectively, in order for a different portion of the pawl to mesh with the ratchet gear.

The sideways pushing button of the direction changing device is located at or adjacent to the gripping end of the ratchet wrench so that a user wishing to control the rotation direction of the ratchet gear can push the sideways pushing button with the same hand that is used to hold the wrench. The foregoing design allows the rotation direction of the wrench to be switched in a narrow space.

BRIEF DESCRIPTION OF THE SEVERAL VIEWS OF THE DRAWINGS

The objectives, features, and effects of the present invention can be better understood by referring to the following detailed description of some preferred embodiments in conjunction with the accompanying drawings, in which.

DETAILED DESCRIPTION OF THE INVENTION

Figure 1:
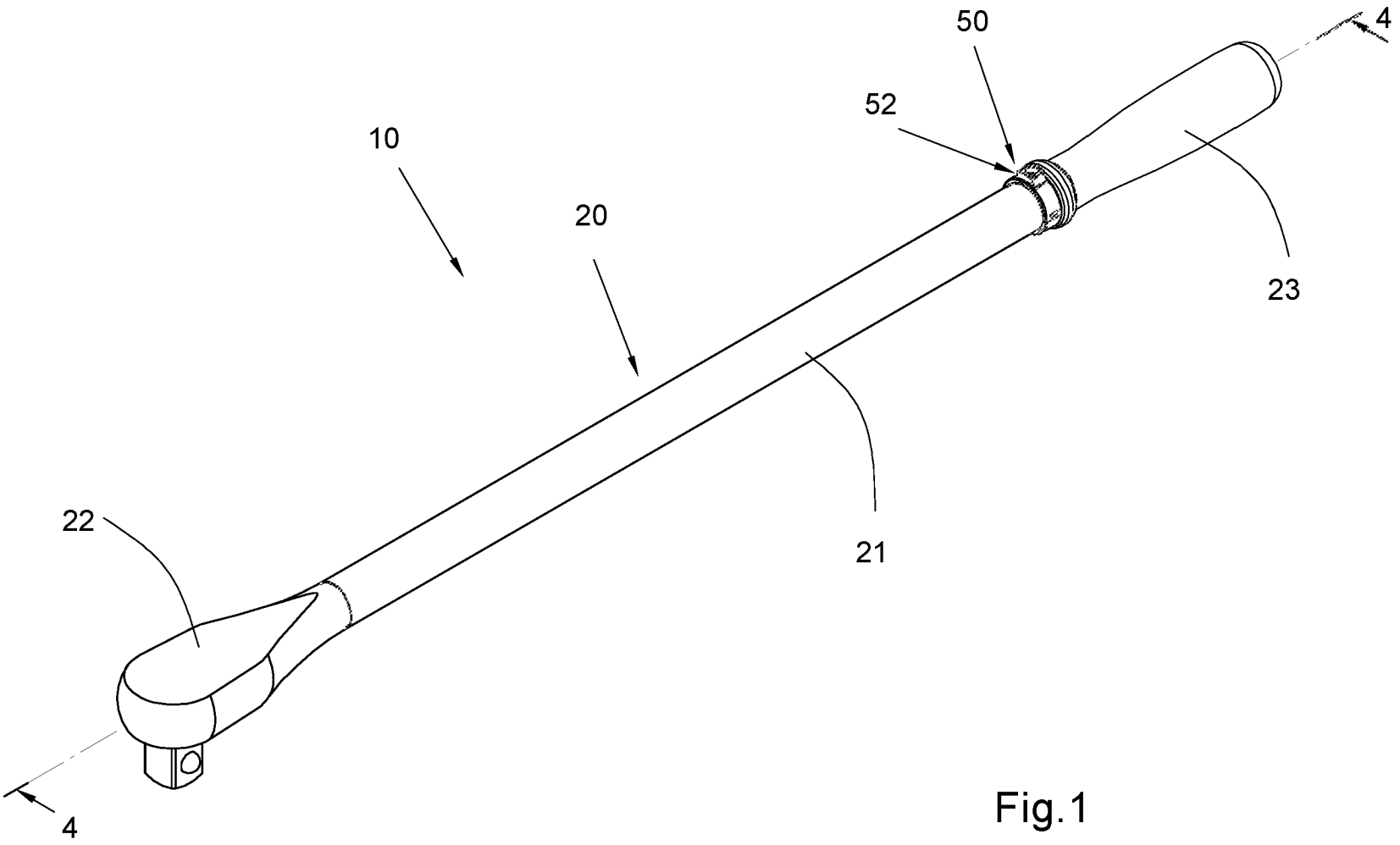
FIG. 1 is a perspective view of the ratchet wrench according to the first preferred embodiment of the invention.
Figure 2:
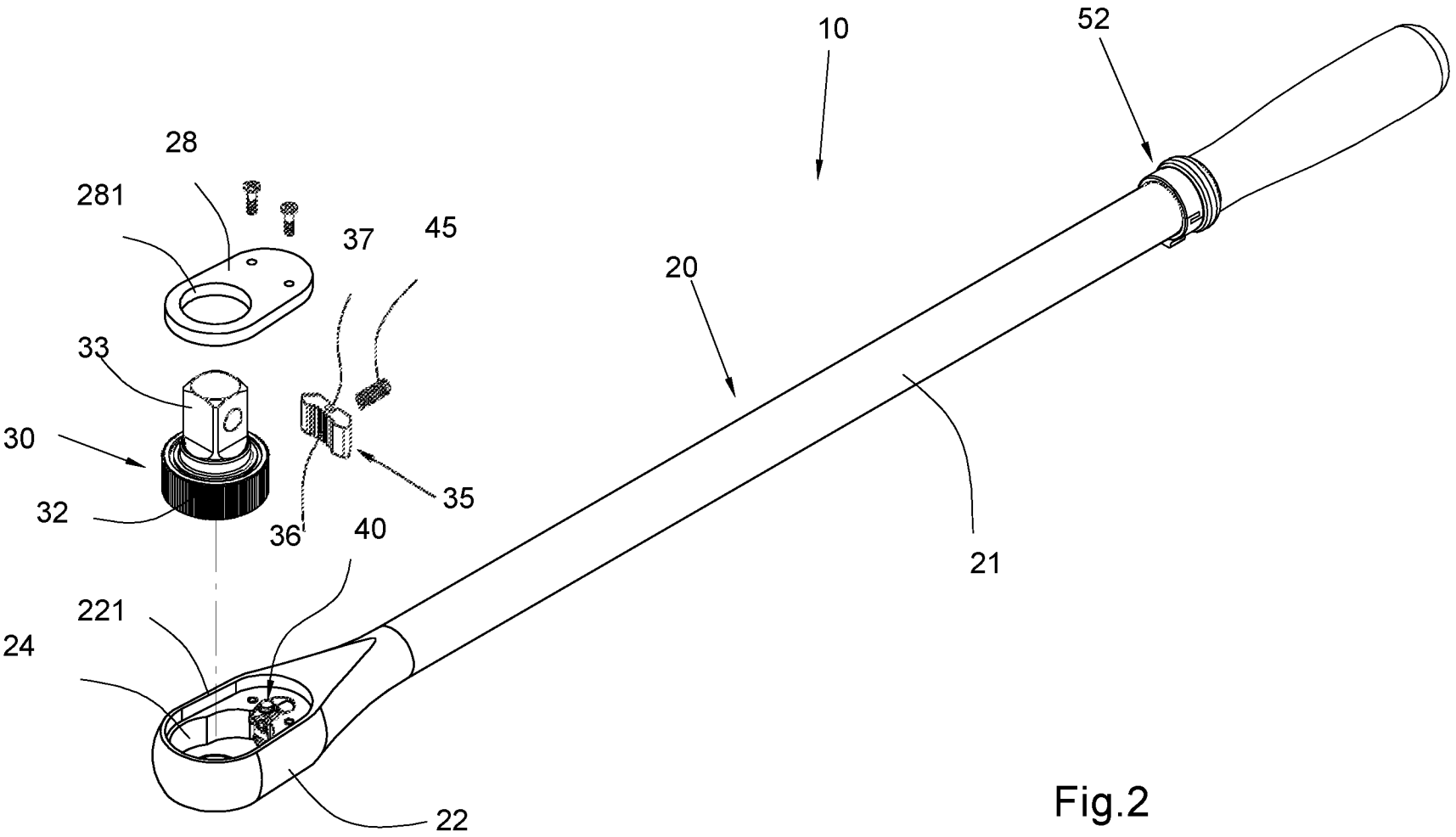
FIG. 2 is a partially exploded bottom perspective view of the wrench in FIG. 1.
Figure 3:
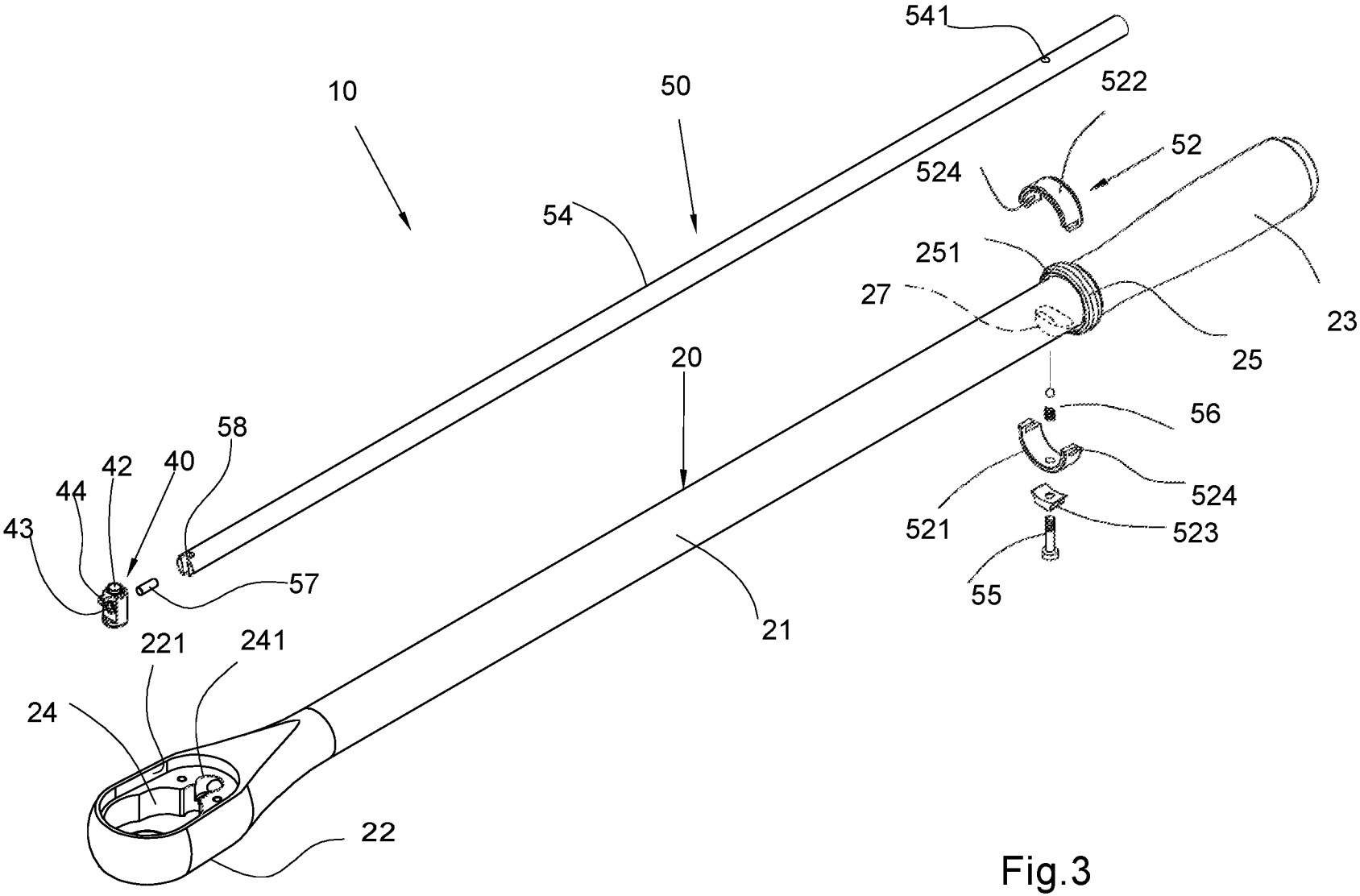
FIG. 3 is an exploded perspective view of the wrench in FIG. 2, with the ratchet gear, pawl, and cover plate removed.

Referring to FIG. 1 to FIG. 3, the ratchet wrench 10 allowing easy change of rotation direction according to the first preferred embodiment of the present invention has a main body 20, a ratchet gear 30, a pawl 35, a sideways pushing member 40, and a direction changing device 50. The direction changing device is configured to switch the rotation direction of the ratchet gear and includes a sideways pushing button provided at or adjacent to a gripping end of the wrench to facilitate operation. The structure and operation method of this preferred embodiment are detailed as follows.

Figure 4:
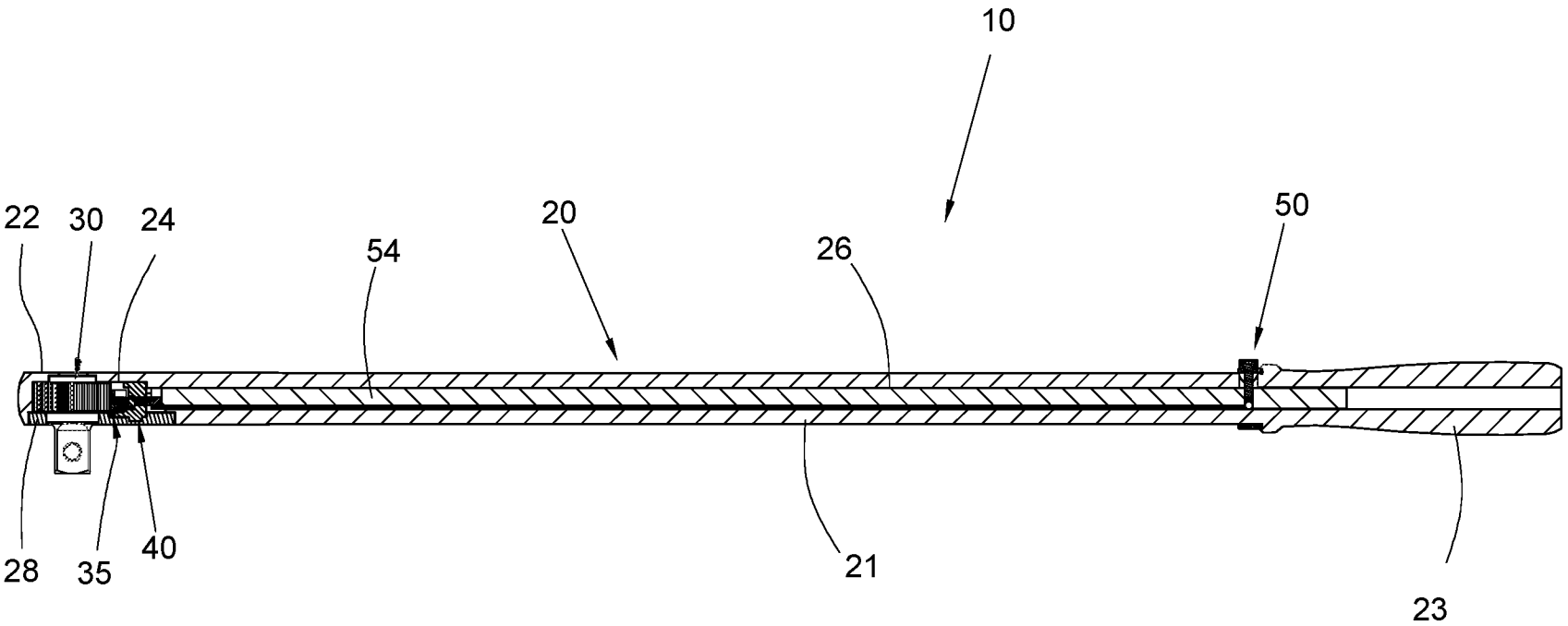
FIG. 4 is a sectional view taken along line 4-4 in FIG. 1.
Figure 6:
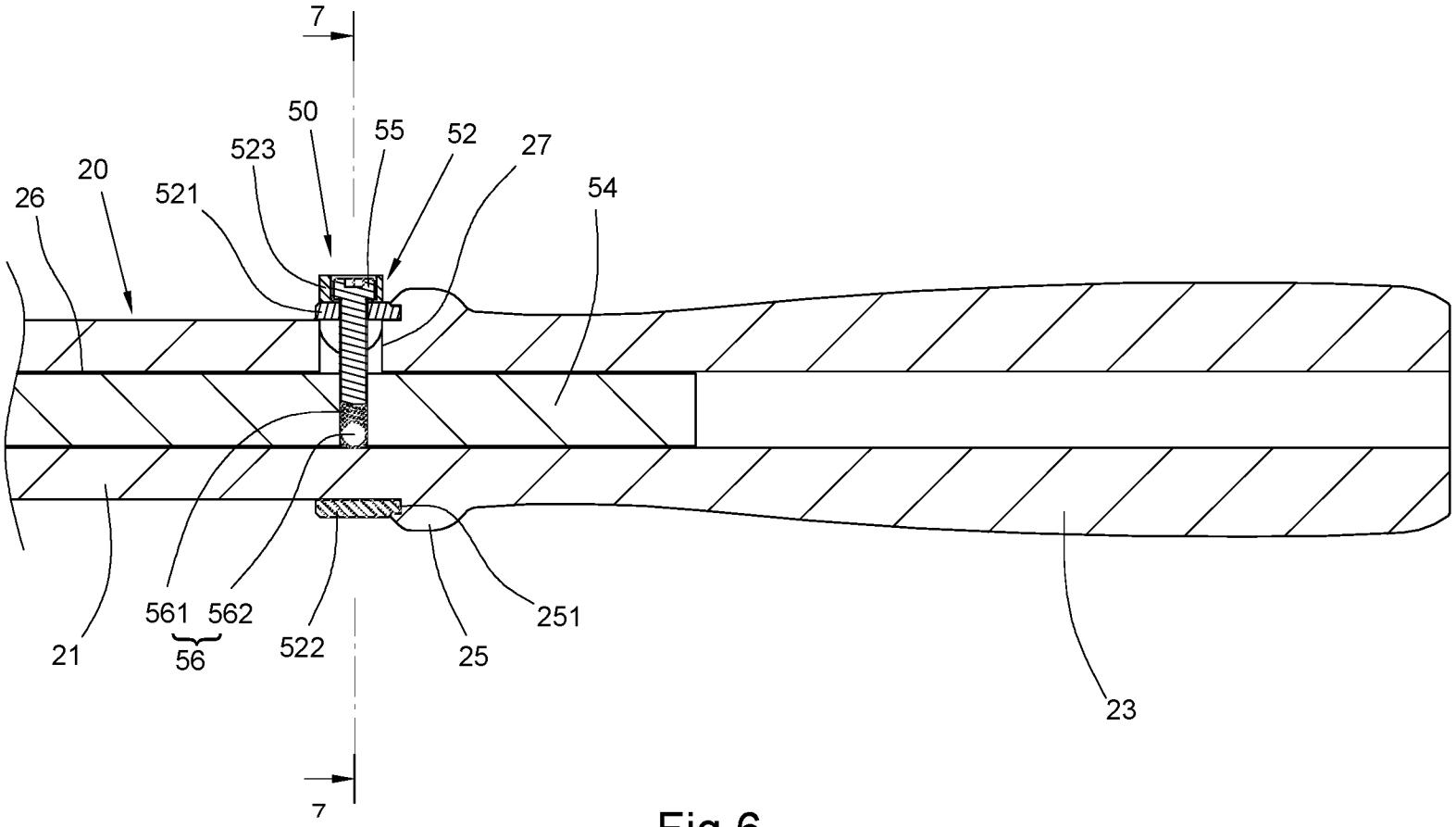
FIG. 6 is another partial enlarged view of FIG. 4, showing the structure of the rear end of the wrench.
Figure 7:
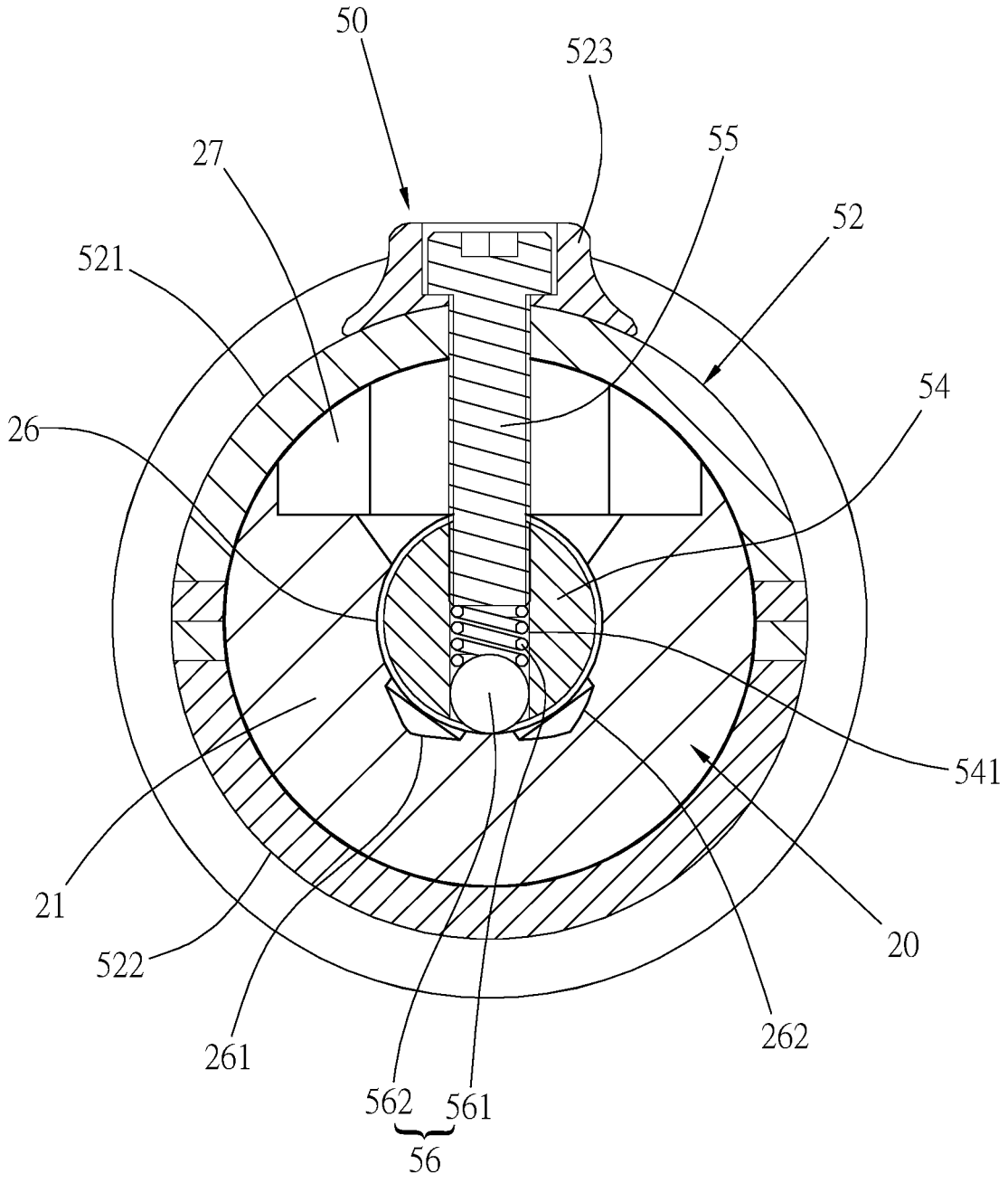
FIG. 7 is a sectional view taken along line 7-7 in FIG. 6.

The main body 20 has a shaft 21 and a head portion 22. The head portion 22 is provided at the front end of the shaft 21. The rear end of the shaft 21 is provided with a gripping end. Preferably, the shaft 21 includes a handle 23 provided at the rear end of the shaft, and the handle 23 forms the gripping end. A receiving chamber 24 is provided in the head portion 22 to receive the ratchet gear 30 and the pawl 35. An opening 221 is provided at the top side or bottom side of the head portion 22. In this embodiment, the opening 221 is provided at the bottom side of the head portion 22 and is in communication with the receiving chamber 24 such that the receiving chamber has a hollow bottom side. Referring to FIG. 4, a longitudinal channel 26 is provided in the shaft 21 along the longitudinal direction of the main body 20. The front end of the channel 26 is connected to the receiving chamber 24 while the rear end of the channel 26 reaches the gripping end (the handle 23) of the shaft 21. Referring to FIG. 6, an open groove 27 is provided in the top edge of the periphery of the rear end of the shaft 21 and is in communication with the channel 26. The open groove 27 may be located at or adjacent to the gripping end (the handle). Preferably, the open groove 27 is located at the junction between the rear end of the shaft and the front end of the handle 23, such as at a position adjacent to the front end of the handle 23. Referring to FIG. 7, the open groove 27 is provided in the shaft 21 along the circumference of the shaft and has a certain length, or arc length, at each of its left and right ends. With continued reference to FIG. 7, the bottom peripheral wall of the channel 26 in the shaft 21 is provided with a first positioning portion 261 and a second positioning portion 262, both corresponding to the open groove 27. Preferably, the two positioning portions 261 and 262 are provided respectively on two opposite lateral sides of the shaft in a symmetric manner. Referring to FIG. 3, a protruding ring 25 is protrudingly provided on the main body 20 at the junction between the handle 23 and the shaft 21.

Figure 5:
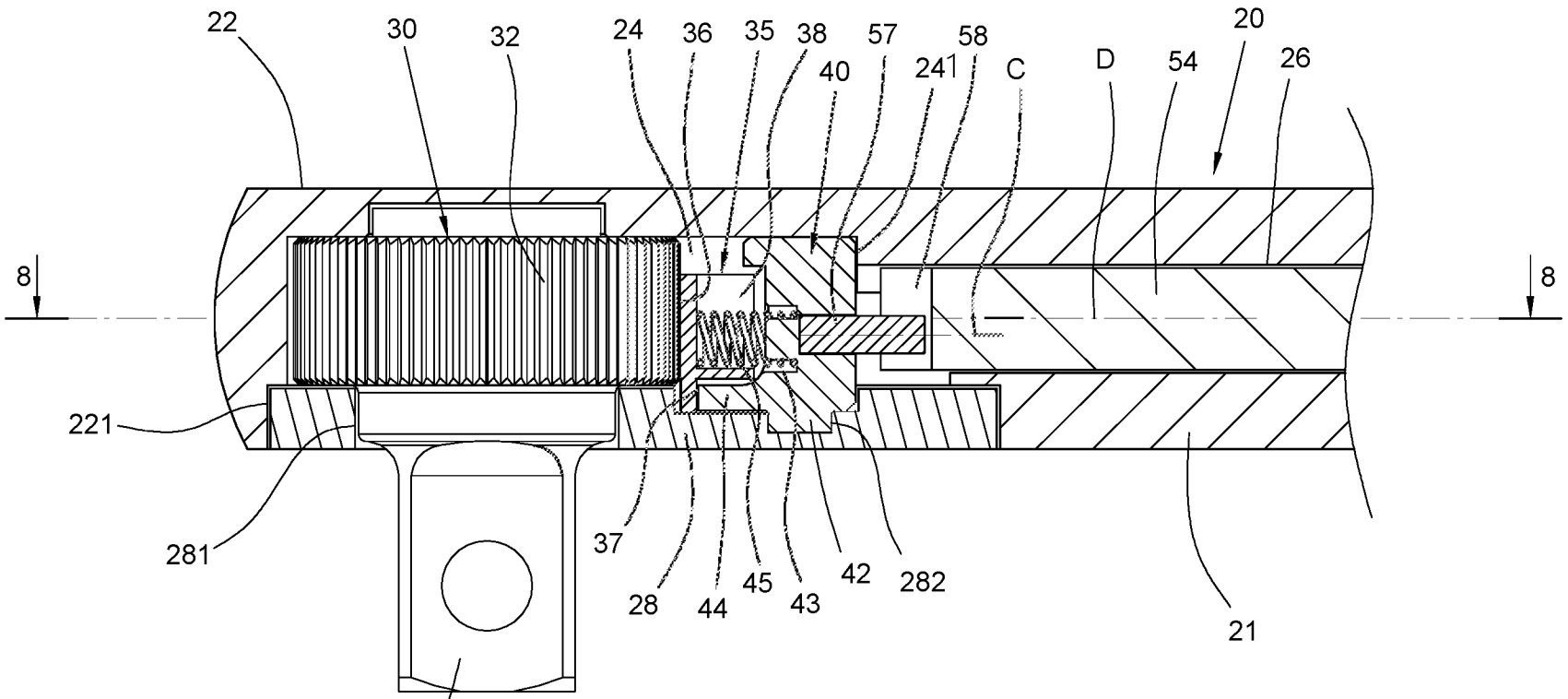
FIG. 5 is a partial enlarged view of FIG. 4, showing the structure of the front end of the wrench.

Referring to FIG. 5, the ratchet gear 30 and the pawl 35 are mounted in the receiving chamber 24 of the head portion 22. The ratchet gear 30 can be rotated in the receiving chamber 24. The pawl 35 can be displaced in the receiving chamber 24 toward each of two opposite lateral sides of the receiving chamber. The pawl 35 has a front end face provided with a plurality of teeth 36 configured to mesh with the teeth 32 on the periphery of the ratchet gear 30. The ratchet gear 30 may be protrudingly provided with an insertion post 33 or be provided with a polygonal mounting hole in order to drive a socket or threaded fastener (e.g., a bolt or nut) through the insertion post or mounting hole. A sealing cover 28 covers the opening 221 of the head portion 22, seals the receiving chamber 24, and thereby retains the ratchet gear 30 and the pawl 35 in the receiving chamber 24, with the insertion post 33 of the ratchet gear 30 extending out of the receiving chamber through a hole 281 in the sealing cover 28.

The rear side of the receiving chamber 24 is further provided with an alcove 241. The sideways pushing member 40 is mounted in the alcove 241 in a rotatable manner. The bottom end of the sideways pushing member 40 is provided with a cylindrical shaft portion 42. The shaft portion 42 is pivotally provided in a pivot hole 282 of the sealing cover 28 and defines the rotation axis of the sideways pushing member 40. A sideways pushing block 44 is protrudingly provided on the front end face of the sideways pushing member and extends into a cavity 37 in the rear end face of the pawl 35 so as to drive the pawl 35 into displacement when the sideways pushing member 40 is rotated. An elastic member 45 such as a compression spring has two opposite ends disposed respectively in a recess 38 in the rear end face of the pawl 35 and an insertion hole 43 in the front end face of the sideways pushing member 40. The elastic member 45 applies an elastic force that keeps the pawl 35 meshing elastically with the ratchet gear 30.

The direction changing device 50 has a sideways pushing button 52, a rotating rod 54, an engaging member 57, and a slot-like engaging groove 58 configured to work with the engaging member 57. The engaging member 57 can be displaced in the engaging groove 58.

The rotating rod 54 is mounted in the channel 26 of the main body 20 and, as shown in FIG. 4 to FIG. 6, can be rotated in the channel 26. The front end of the rotating rod 54 is aligned with the sideways pushing member 40, and the rear end of the rotating rod 54 reaches the open groove 27 of the shaft 21. A diametric hole 541 is provided in, and along a diameter of, the rotating rod 54 and penetrates the rotating rod. The diametric hole 541 corresponds to the open groove 27 of the shaft 21.

The sideways pushing button 52 is mounted on the shaft, is connected to the rotating rod 54 through the open groove 27, and is configured to be pushed sideways by the user. The sideways pushing button can drive the rotating rod 54 into rotation until the rotating rod 54 is secured at one of two predetermined positions. More specifically, the sideways pushing button 52 in this embodiment is in the shape of a ring and has a semicircular first half portion 521 and a semicircular second half portion 522. The two ends of each of the two half portions 521 and 522 are each provided with a hook portion 524 and are respectively hooked to the two ends of the other half portion through the hook portions such that a circular ring is formed. The sideways pushing button 52 is mounted around the periphery of the shaft 21 and can be rotated on the shaft. The rear end edge of the sideways pushing button 52 is engaged in an annular groove 251 in the protruding ring 25. A protruding sideways pushing portion 523 is provided on the first half portion 521 and is located at the top edge of the shaft 21 so that a user can easily push and thereby rotate the sideways pushing button 52 through the sideways pushing portion 523. A connecting member 55 extends through the open groove 27 and has one end connected to the sideways pushing button 52 and the opposite end inserted into and connected with one end (the top end) of the diametric hole 541 of the rotating rod 54 such that the sideways pushing button 52 is connected to the rotating rod 54.

An elastic positioning element 56 is mounted at the other end (the bottom end) of the diametric hole 541 of the rotating rod 54 and can be elastically exposed from the bottom side of the periphery of the rotating rod 54 or moved into the diametric hole 541 of the rotating rod. The elastic positioning element 56 includes an elastic member 561 and a ball 562. The ball 562 is elastically biased by the elastic member 561 and can be exposed from or moved into the rotating rod 54.

Figure 8:
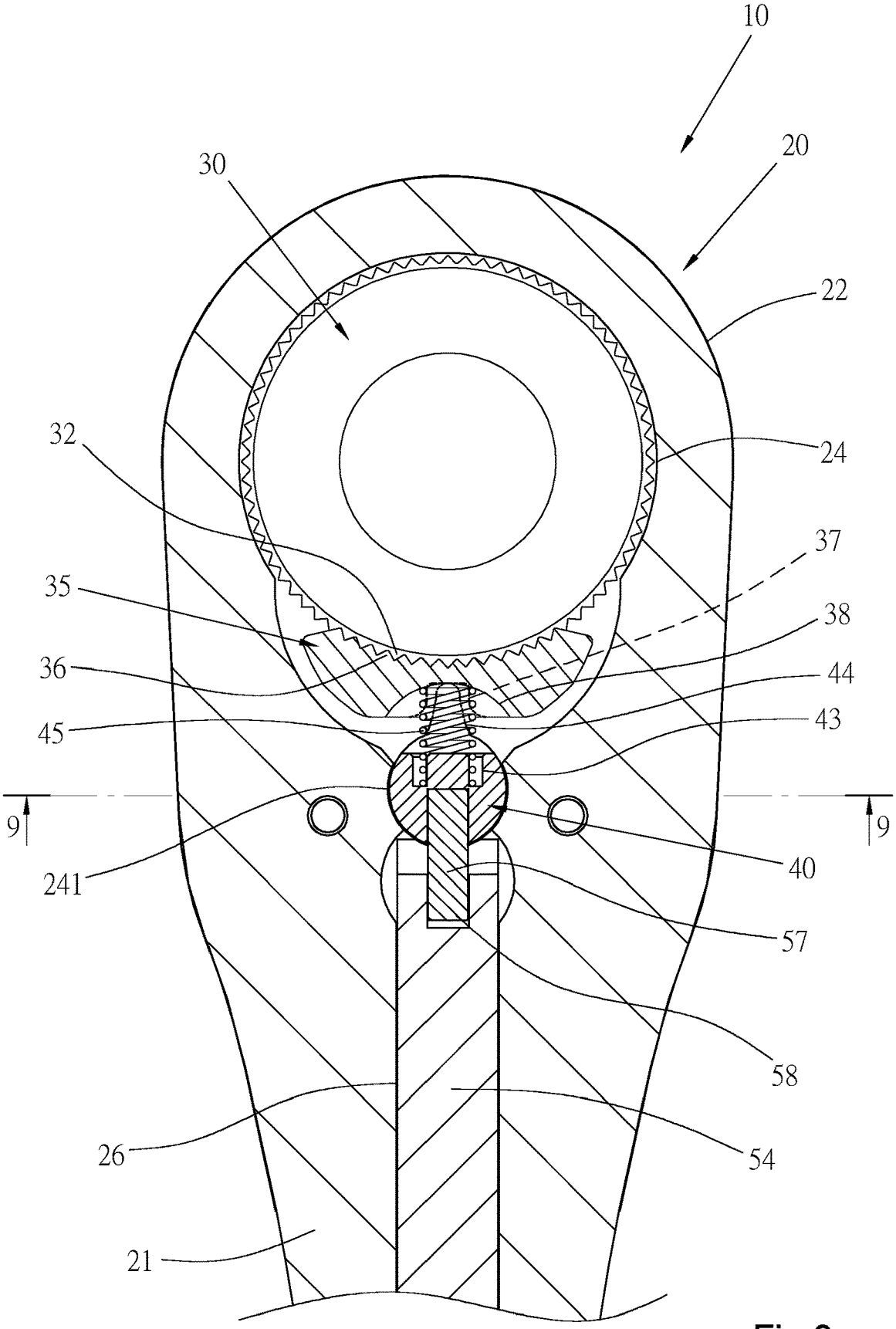
FIG. 8 is a sectional view taken along line 8-8 in FIG. 5.
Figure 9:
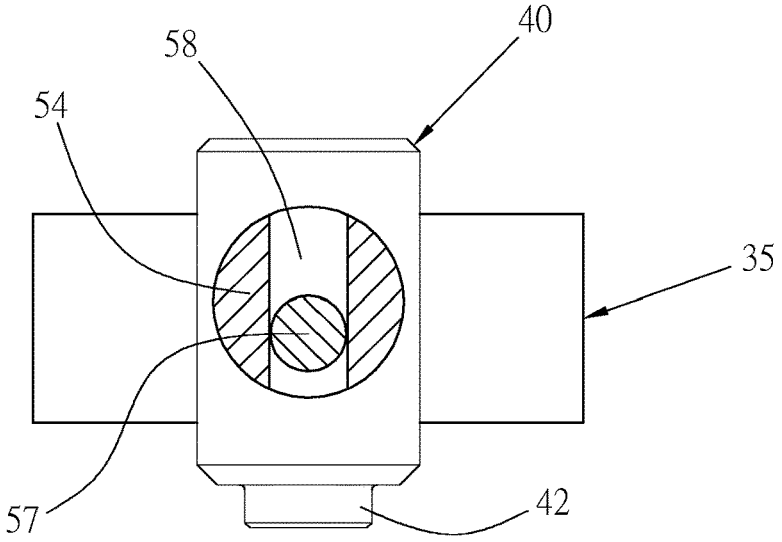
FIG. 9 is a sectional view taken along line 9-9 in FIG. 8, showing only the rotating rod, the sideways pushing member, and the pawl.

The engaging member 57 and the engaging groove 58 are provided at the rear end face of the sideways pushing member 40 and the front end face of the rotating rod 54 respectively or vice versa and are engaged with each other. In this embodiment, referring to FIG. 5 and FIG. 8, the engaging member 57 is shaped as a straight rod and has its front end (the connecting end) inserted into the rear end face of the sideways pushing member 40, and the engaging groove 58 is provided in the front end face of the rotating rod 54 and has a longitudinal direction defined as extending through the top and bottom edges of the wrench, with the rear end (the free end) of the engaging member 57 engaged in the engaging groove 58. As shown in FIG. 5, the engaging member 57 has a central axis C, and the rotating rod 54 has a central axis D. The central axis C of the engaging member 57 and the central axis D of the rotating rod 54 are offset from each other in the longitudinal direction of the engaging groove 58; in other words, the center of the free end of the engaging member 57 is offset from the central axis D of the rotating rod. Through the cooperation between the engaging member 57 and the rotating rod 54, therefore, the rotating rod 54 can drive the sideways pushing member 40 into clockwise or counterclockwise rotation when rotated.

Figure 10:
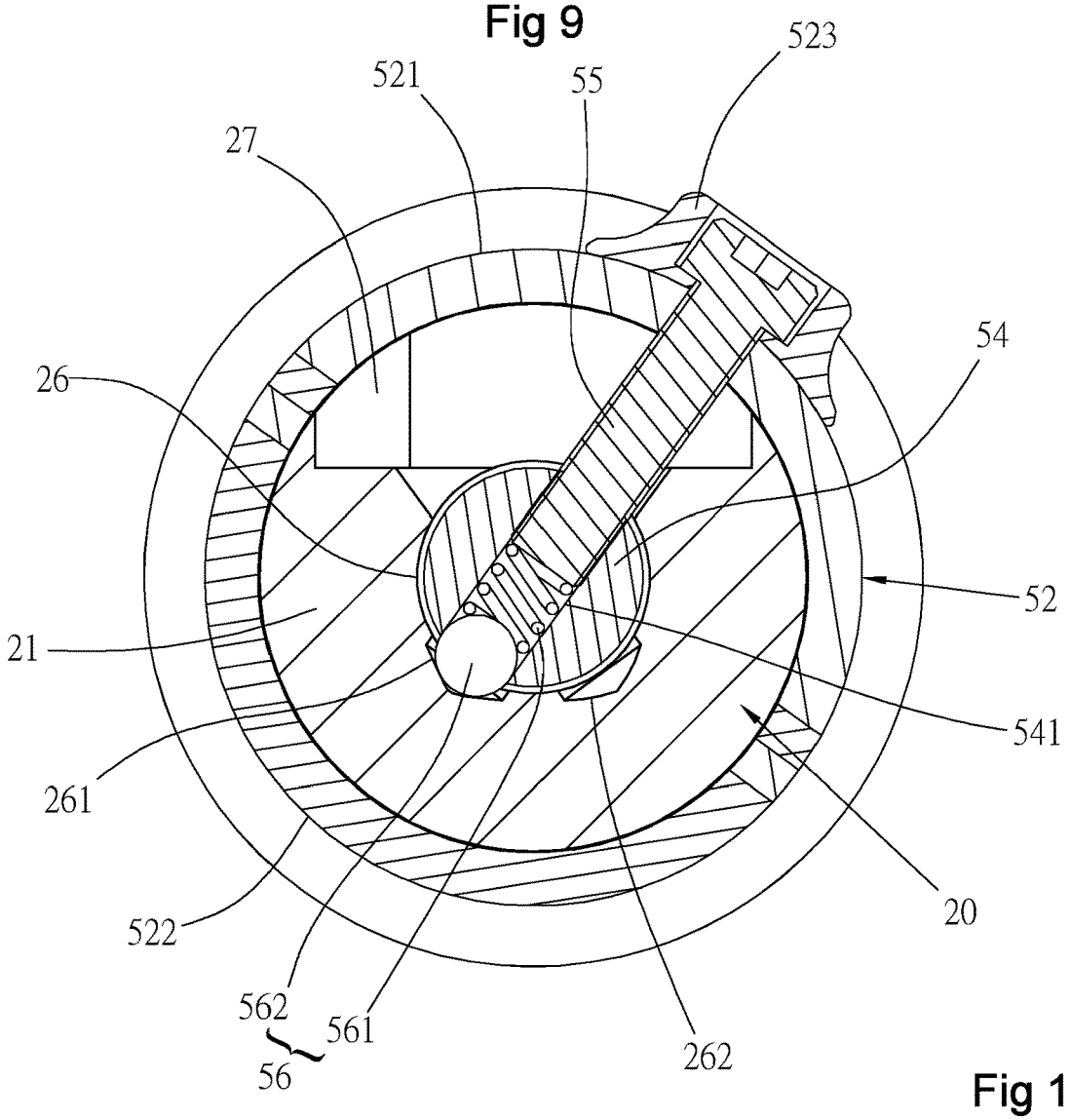
FIG. 10 and FIG. 13 are generally the same as FIG. 7, showing the direction changing device secured in position by a first positioning portion and a second positioning portion respectively.
Figure 11:
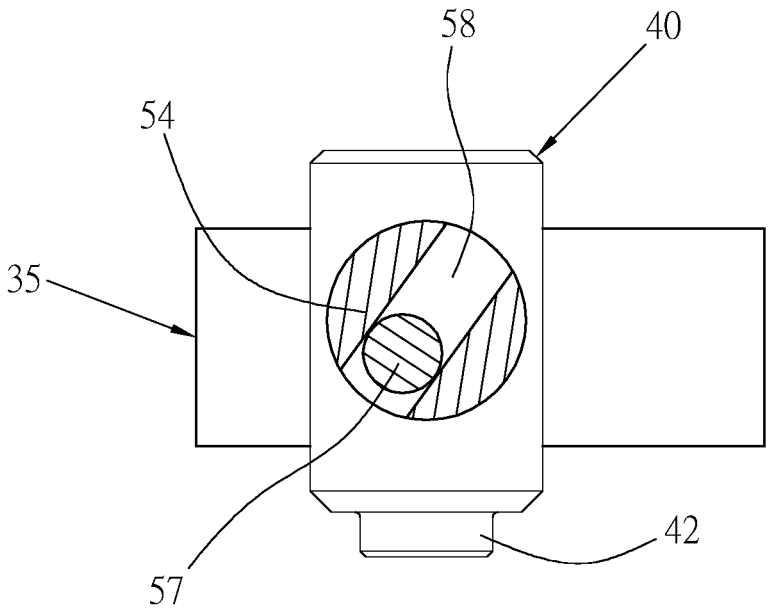
FIG. 11 and FIG. 14 are generally the same as FIG. 9, showing clockwise rotation and counterclockwise rotation of the rotating rod respectively.
Figure 12:
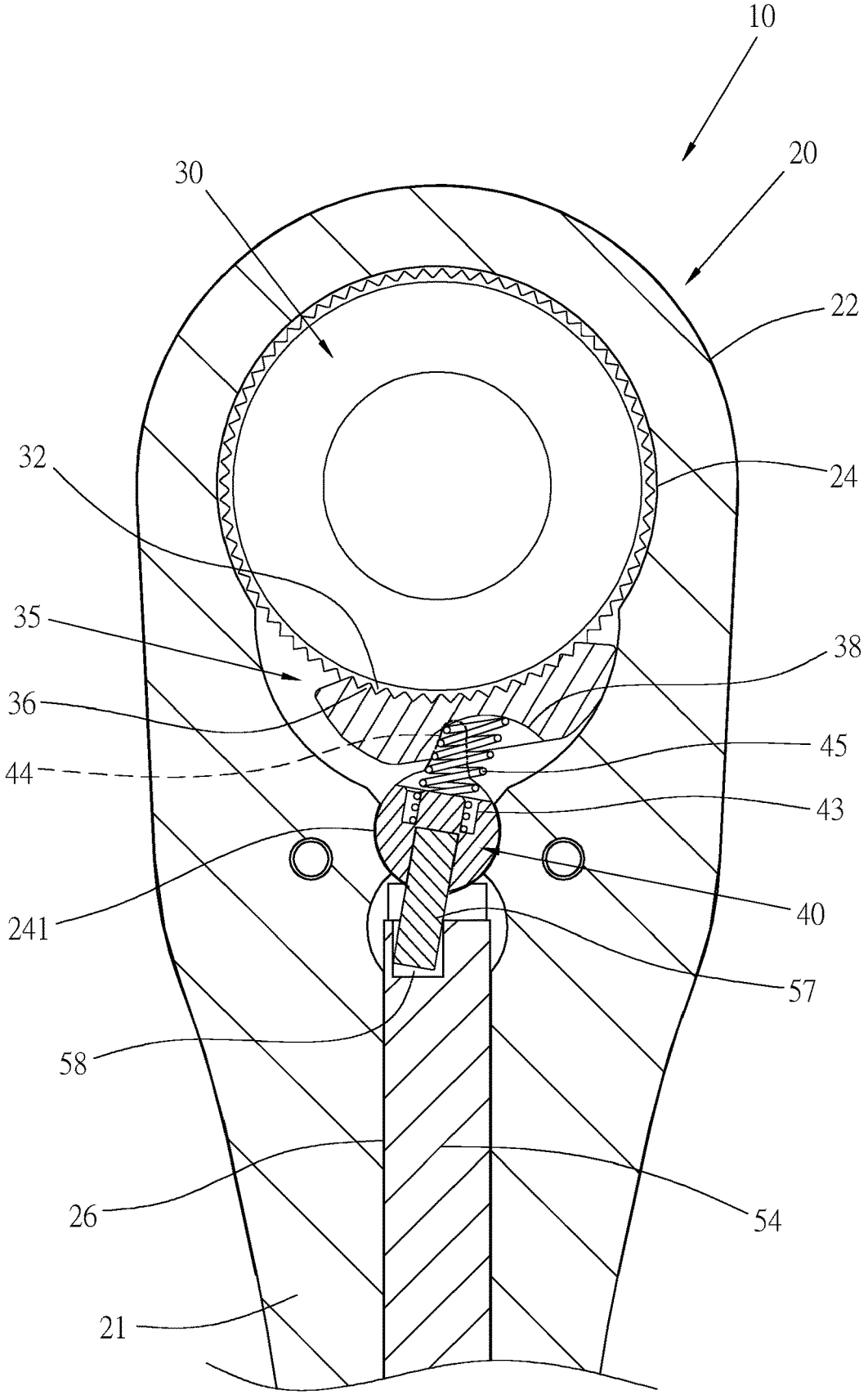
FIG. 12 and FIG. 15 are generally the same as FIG. 8, showing the sideways pushing member moving the pawl toward the right side and the left side of the head portion respectively.

The following paragraphs explain the direction changing operation and working mechanism of the ratchet wrench 10. The directional terms used below, such as clockwise, counterclockwise, left, and right, make reference to the directions presented in the drawings. Referring to FIG. 10, when the sideways pushing button 52 is pushed to the right via the sideways pushing portion 523, the rightward displacement of the sideways pushing button 52 causes the rotating rod 54 to rotate clockwise in the channel 26 until the ball 562 of the positioning element 56 is elastically engaged in the first positioning portion 261 and thereby secures the sideways pushing button 52 and the rotating rod 54 at a first position. During the process, referring to FIG. 11 and FIG. 12, the engaging groove 58 undergoes a clockwise angular displacement and thereby moves the engaging member 57 to one side, resulting in a clockwise angular displacement of the sideways pushing member 40. The sideways pushing block 44 of the sideways pushing member 40, in turn, drives the pawl 35 toward the right side of the receiving chamber 24 such that the pawl 35 is pressed against the right side wall of the receiving chamber as shown in FIG. 12. If the wrench 10 is rotated clockwise in this state, the ratchet gear 30 can and will be simultaneously driven into clockwise rotation because the pawl 35 and the ratchet gear 30 will stay meshing with each other. Conversely, rotating the wrench 10 counterclockwise will cause the pawl 35 to jump on the periphery of the ratchet gear 30, meaning the wrench 10 cannot effectively, let alone simultaneously, drive the ratchet gear 30 into rotation.

Figure 14:
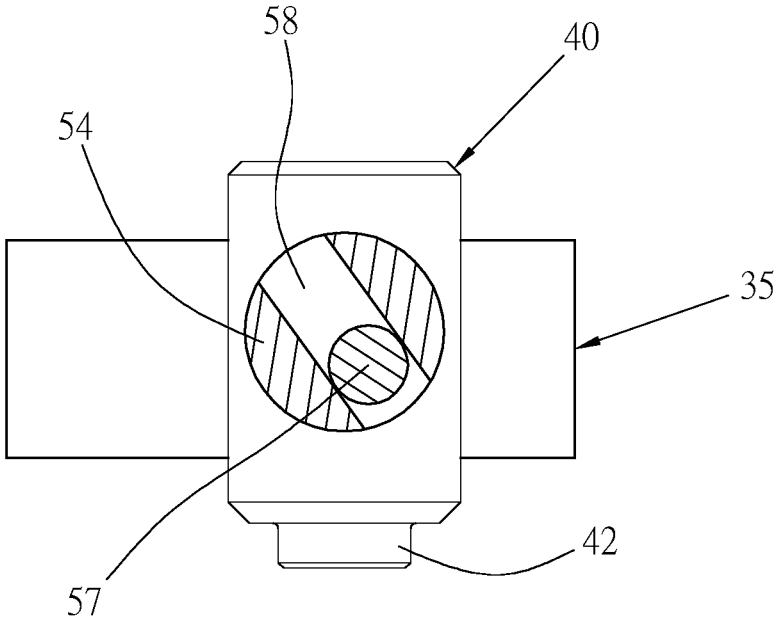
Figure 13:
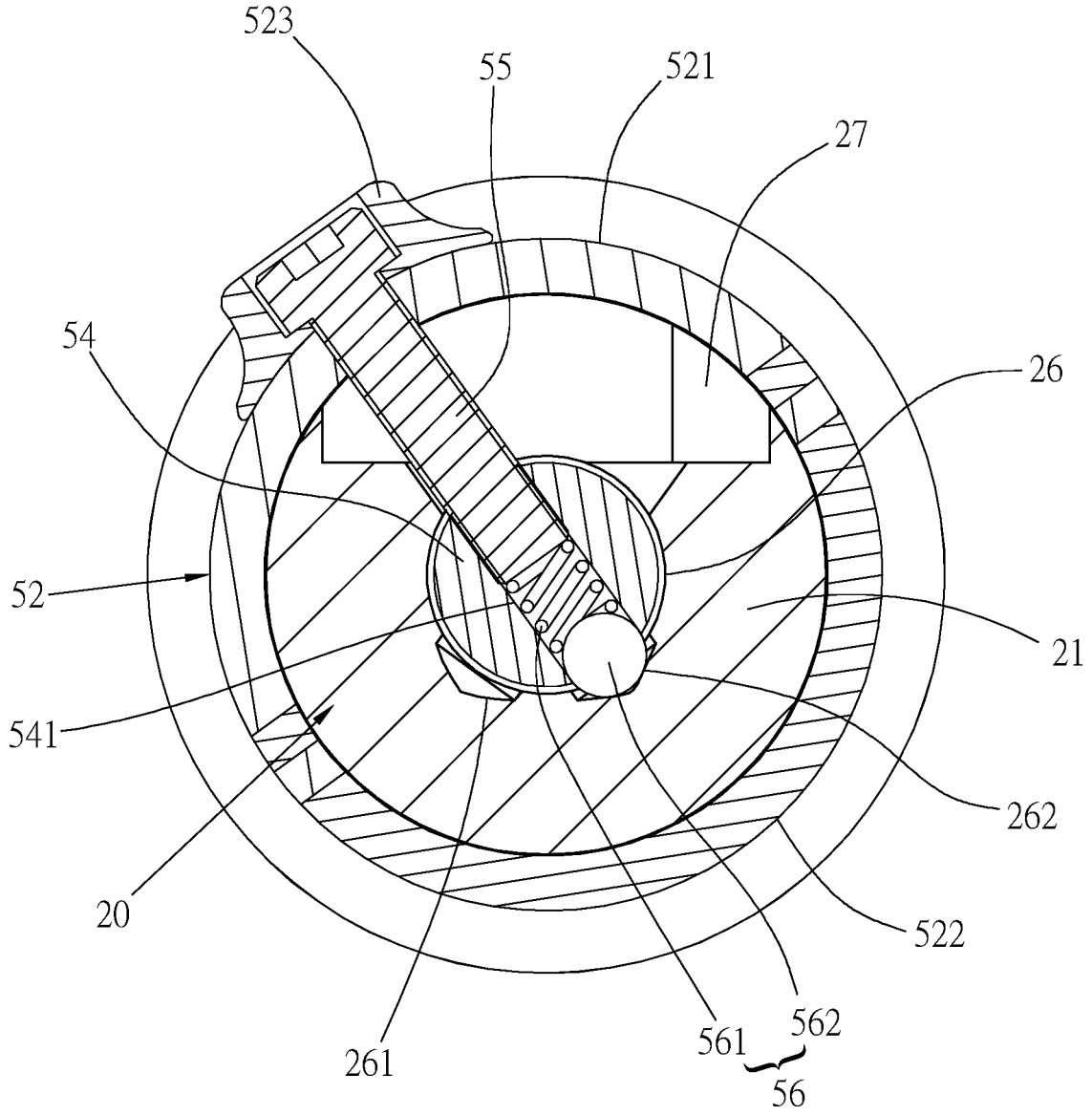
Figure 15:
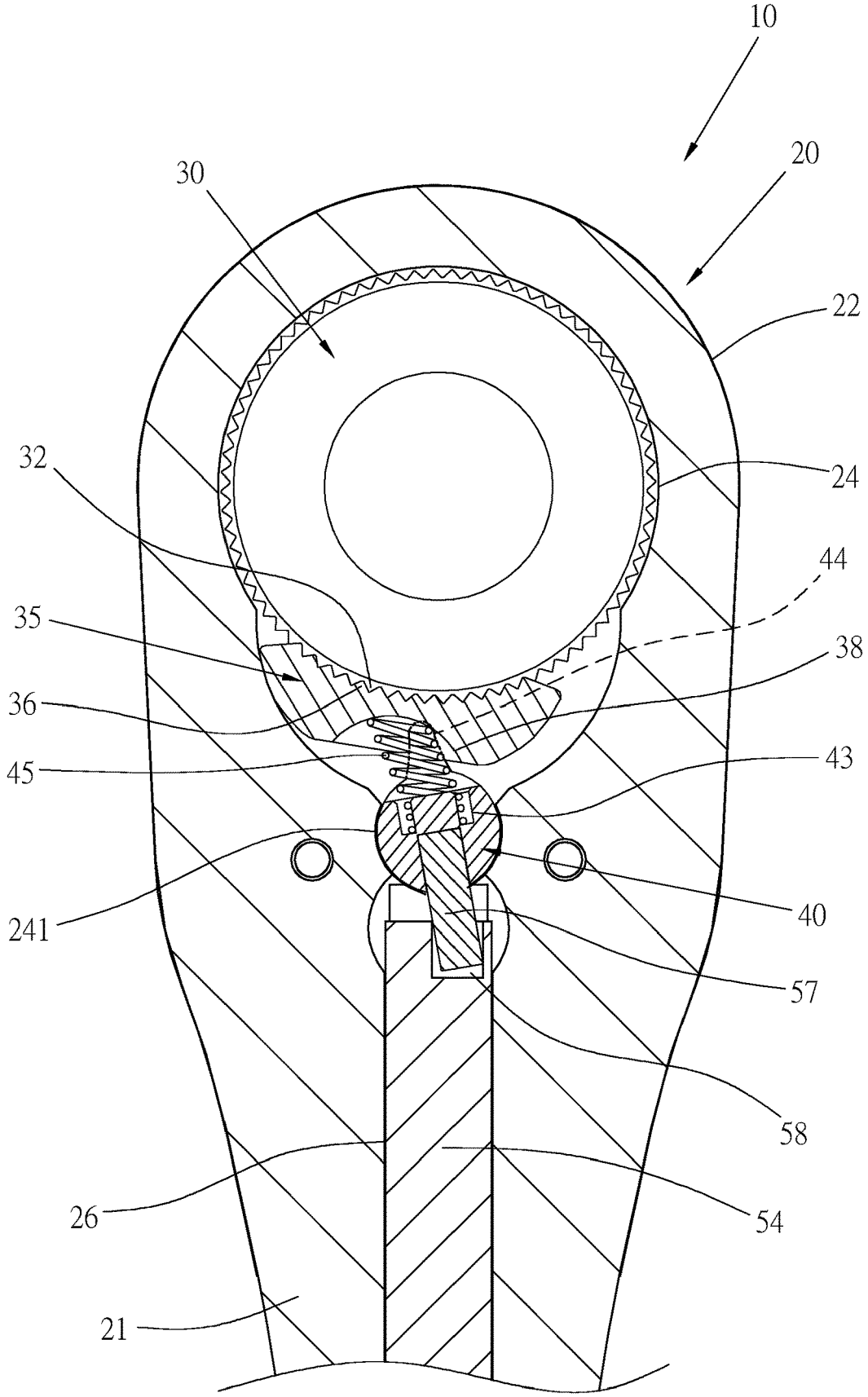

Referring to FIG. 13, when the sideways pushing button 52 is pushed to the left, the rotating rod 54 is driven to rotate counterclockwise in the channel 26 by the sideways pushing button 52, and the ball 562 of the positioning element 56 is moved away from the first positioning portion 261 and ends up elastically engaged in the second positioning portion 262, thereby securing the sideways pushing button 52 and the rotating rod 54 at a second position. During the process, referring to FIG. 14 and FIG. 15, the engaging groove 58 undergoes a counterclockwise angular displacement and thereby moves the engaging member 57 to the other side, resulting in a counterclockwise angular displacement of the sideways pushing member 40. The sideways pushing block 44 of the sideways pushing member 40, in turn, drives the pawl 35 toward the left side of the receiving chamber 24 such that the pawl 35 is pressed against the left side wall of the receiving chamber as shown in FIG. 15. If the wrench 10 is rotated counterclockwise in this state, the ratchet gear 30 can and will be simultaneously driven into counterclockwise rotation because the pawl 35 and the ratchet gear 30 will stay meshing with each other. Conversely, rotating the wrench 10 clockwise will cause the pawl 35 to jump on the periphery of the ratchet gear 30, meaning the wrench 10 cannot effectively, let alone simultaneously, drive the ratchet gear 30 into rotation.

Figure 16:
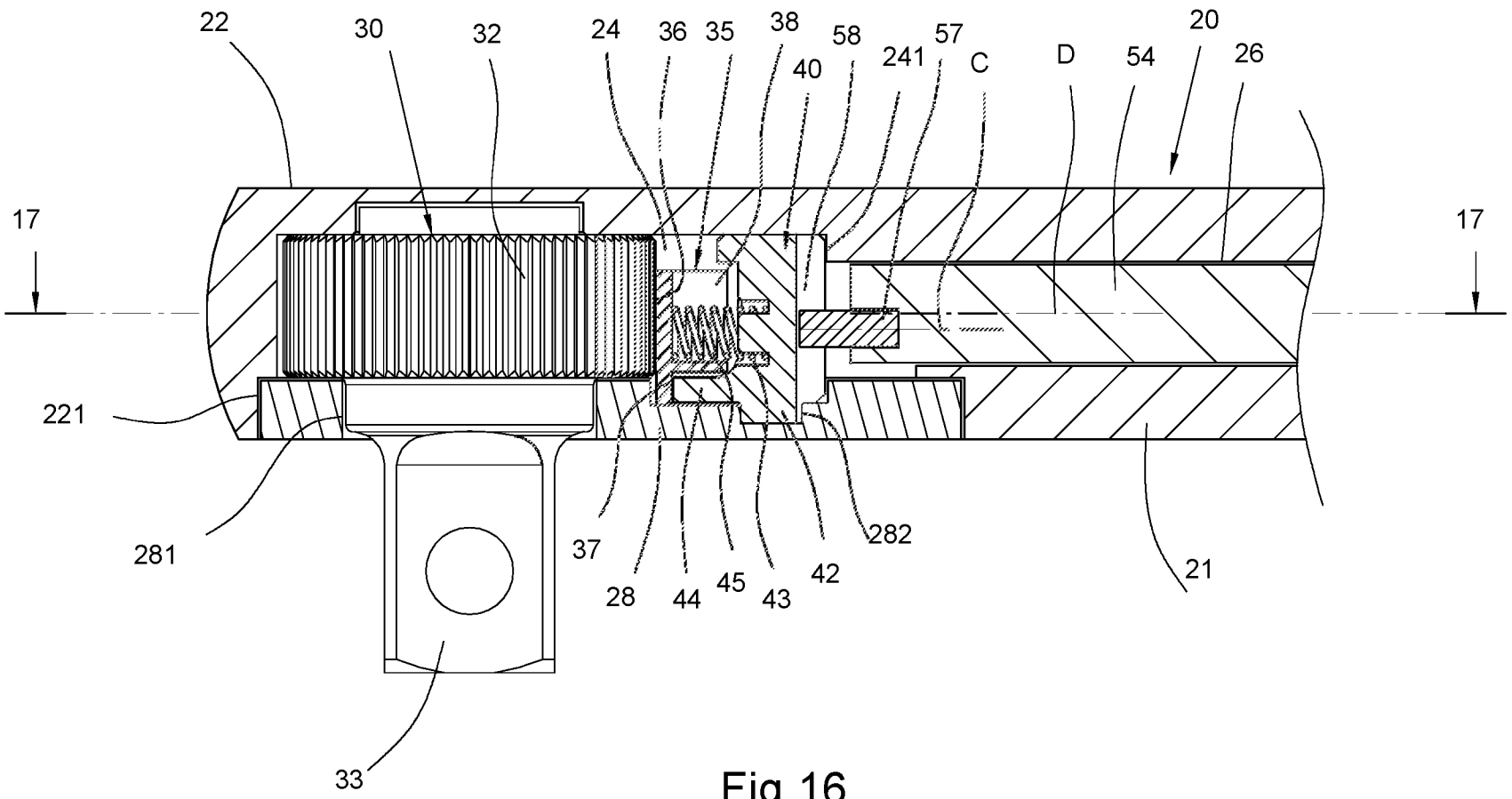
FIG. 16 is a longitudinal sectional view of the ratchet wrench according to the second preferred embodiment of the invention.
Figure 17:
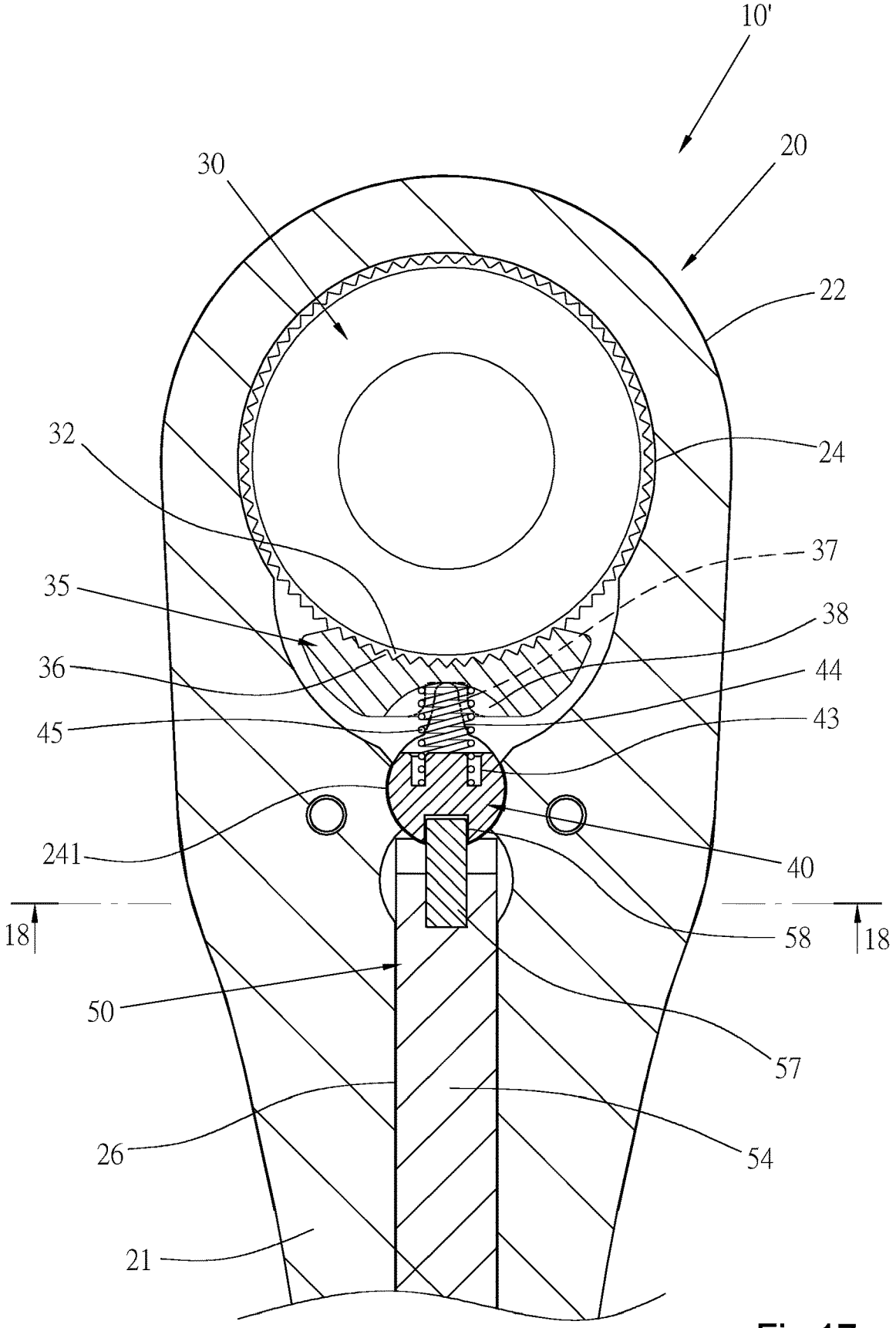
FIG. 17 is a sectional view taken along line 17-17 in FIG. 16.
Figure 18:
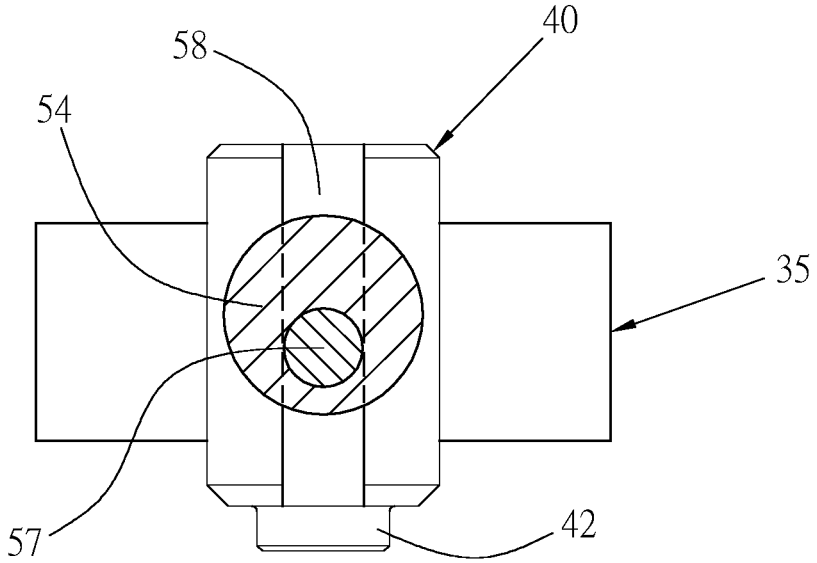
FIG. 18 is a sectional view taken along line 18-18 in FIG. 17, showing only the rotating rod, the sideways pushing member, and the pawl.

FIG. 16 to FIG. 18 show the ratchet wrench 10' according to the second preferred embodiment of the present invention. Like the ratchet wrench 10 in the first preferred embodiment, the ratchet wrench 10' includes the main body 20, the ratchet gear 30, the pawl 35, the sideways pushing member 40, the elastic member 45, the direction changing device 50, the engaging member 57, and the engaging groove 58. The same components in the first and the second preferred embodiments are indicated by the same reference numeral, and the structural features of those components can be understood by referring back to the description of the first preferred embodiment and therefore will not be described repeatedly. It is worth mentioning that, although not shown in the drawings of the second preferred embodiment, the sideways pushing button of the direction changing device in this embodiment has the same structure as its counterpart in the first preferred embodiment.

The second preferred embodiment is different from the first preferred embodiment in that the rear end of the engaging member 57 is inserted in the front end face of the rotating rod 54, and that the engaging groove 58 is provided in the rear end face of the sideways pushing member 40, wherein the engaging member 57 and the engaging groove 58 are engaged with each other.

Figure 19:
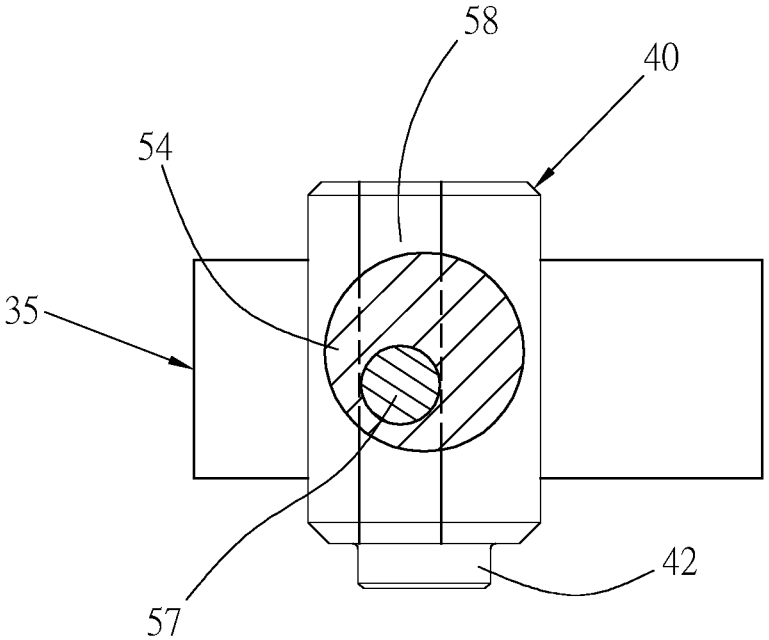
FIG. 19 and FIG. 21 are generally the same as FIG. 18, showing clockwise rotation and counterclockwise rotation of the rotating rod respectively.
Figure 20:
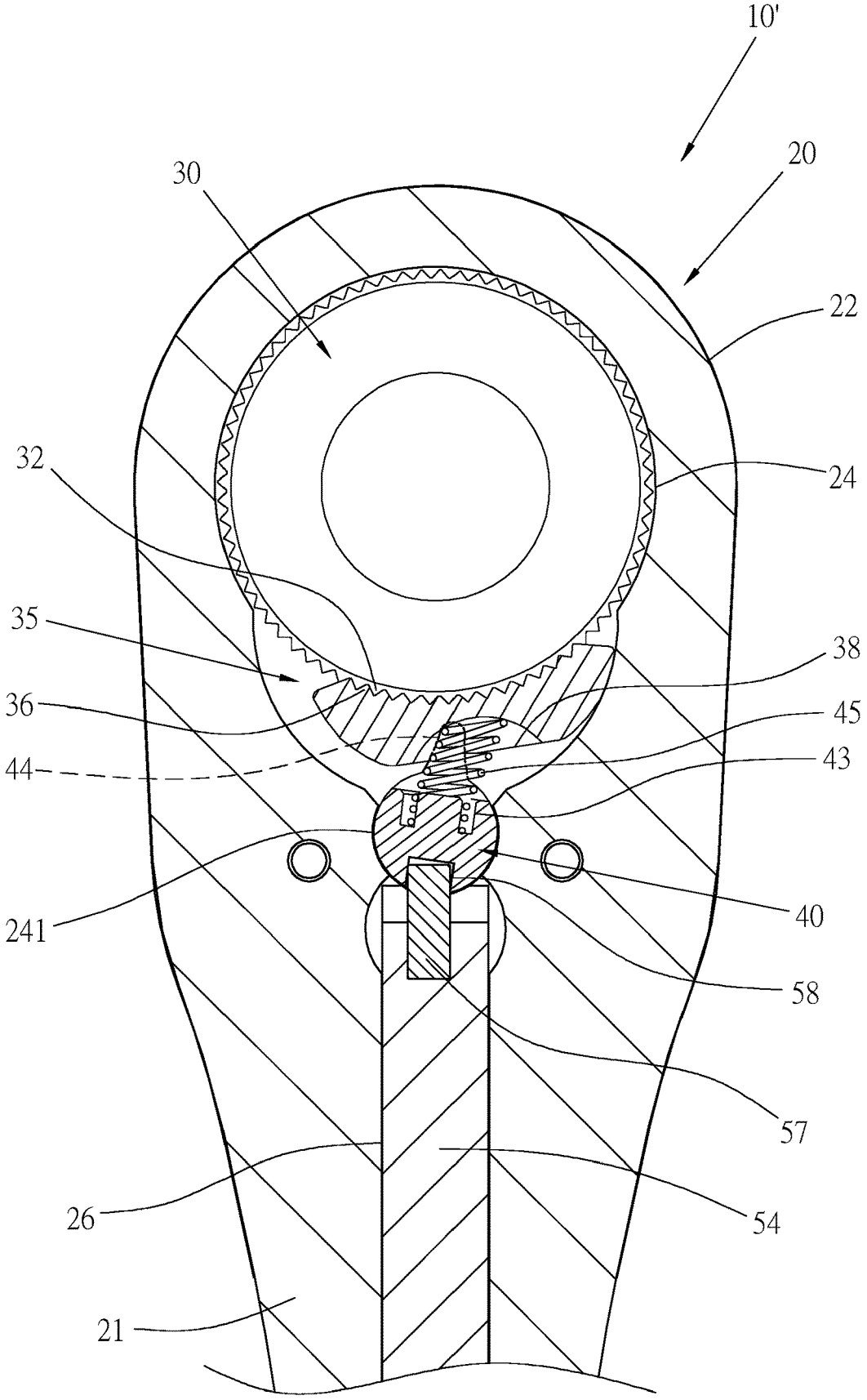
FIG. 20 and FIG. 22 are generally the same as FIG. 17, showing the sideways pushing member moving the pawl toward the right side and the left side of the head portion respectively.

The following paragraphs explain the direction changing operation and working mechanism of the ratchet wrench 10'. The directional terms used below, such as clockwise, counterclockwise, left, and right, make reference to the directions presented in the drawings. Referring to FIG. 19, rotating the sideways pushing button of the direction changing device 50 to the right will cause the rotating rod 54 to rotate clockwise in the channel 26 until the rotating rod 54 is secured at the first position. During the process, referring to FIG. 20, the engaging member 57 is moved to one side and drives the sideways pushing member 40 through the engaging groove 58 such that the sideways pushing member 40 is rotated clockwise. The sideways pushing block 44 of the sideways pushing member 40, in turn, moves the pawl 35 to the right and eventually presses the pawl 35 against the right side wall of the receiving chamber 24. The wrench 10' in this state can only be rotated clockwise in order to drive the ratchet gear 30 to rotate at the same time. The wrench 10' in this state cannot effectively, let alone simultaneously, drive the ratchet gear 30 into rotation when rotated counterclockwise.

Figure 21:
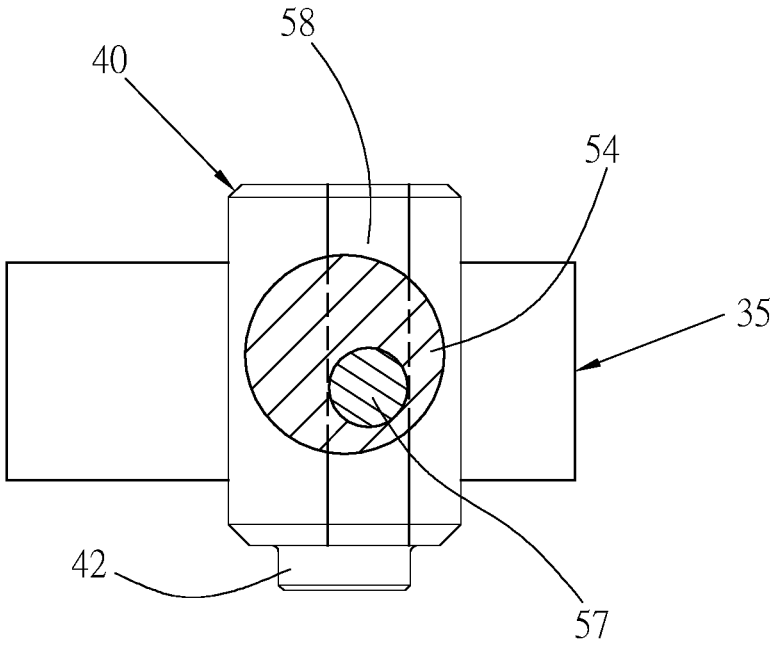
Figure 22:
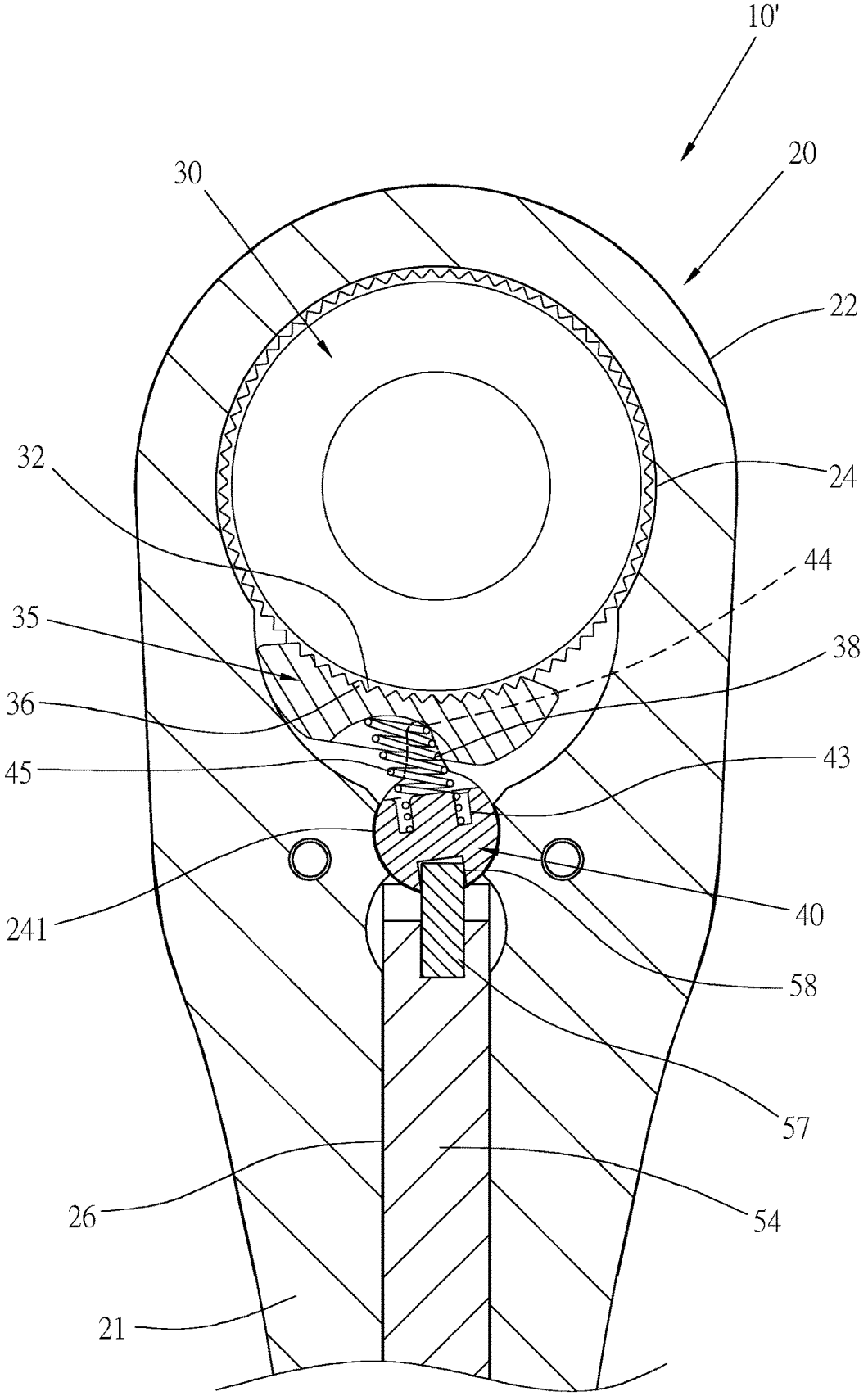

Referring to FIG. 21, rotating the sideways pushing button of the direction changing device 50 to the left will cause the rotating rod 54 to rotate counterclockwise in the channel 26 until the rotating rod 54 is secured at the second position. During the process, referring to FIG. 21 and FIG. 22, the engaging member 57 is moved to the other side and drives the sideways pushing member 40 through the engaging groove 58 such that the sideways pushing member 40 is rotated counterclockwise. The sideways pushing block 44 of the sideways pushing member 40, in turn, moves the pawl 35 to the left and eventually presses the pawl 35 against the left side wall of the receiving chamber 24. The wrench 10' in this state can only be rotated counterclockwise in order to drive the ratchet gear 30 to rotate at the same time. The wrench 10' in this state cannot effectively, let alone simultaneously, drive the ratchet gear 30 into rotation when rotated clockwise.

Figure 23:
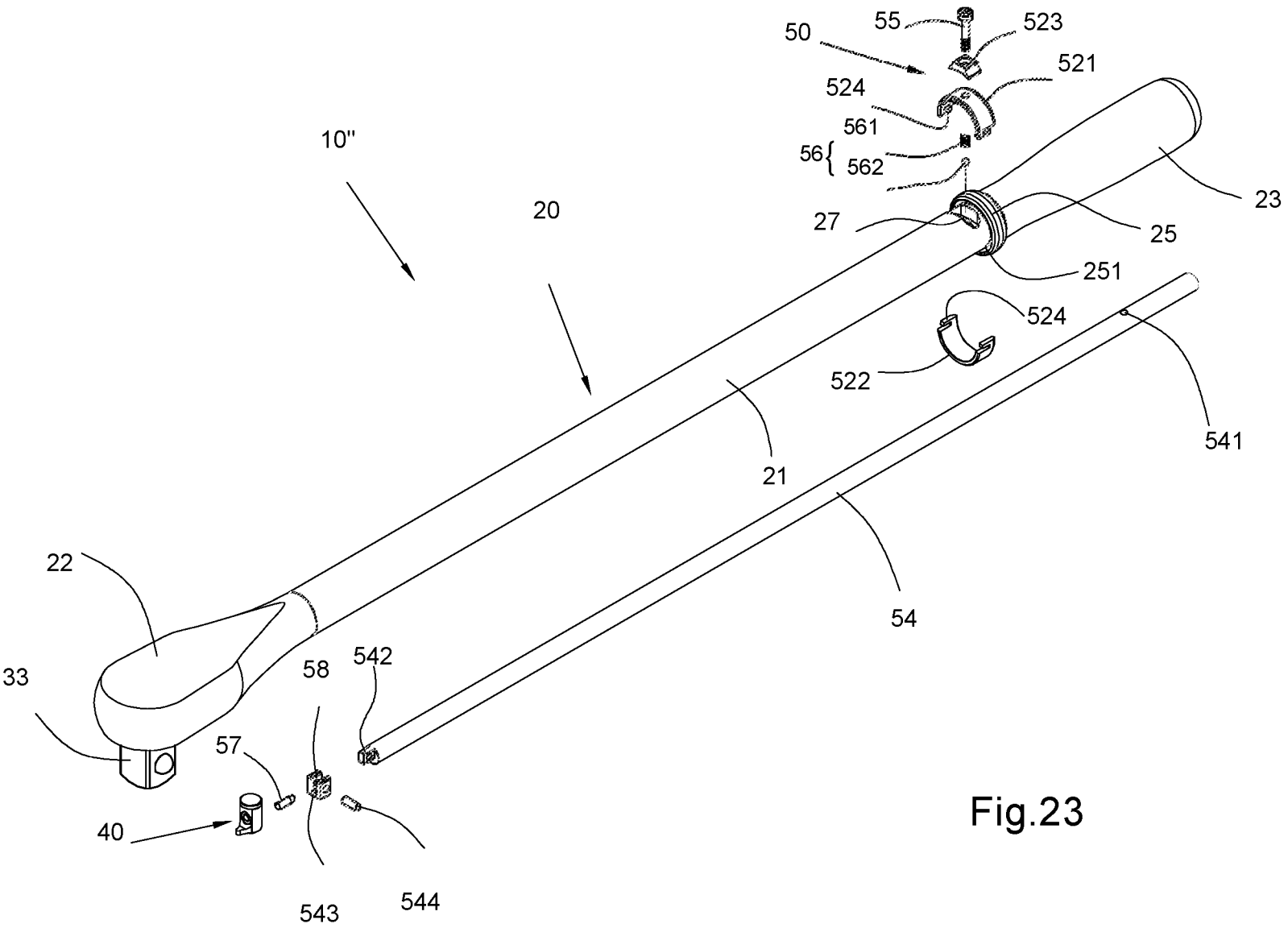
FIG. 23 is a partially exploded perspective view of the ratchet wrench according to the third preferred embodiment of the invention.
Figure 24:
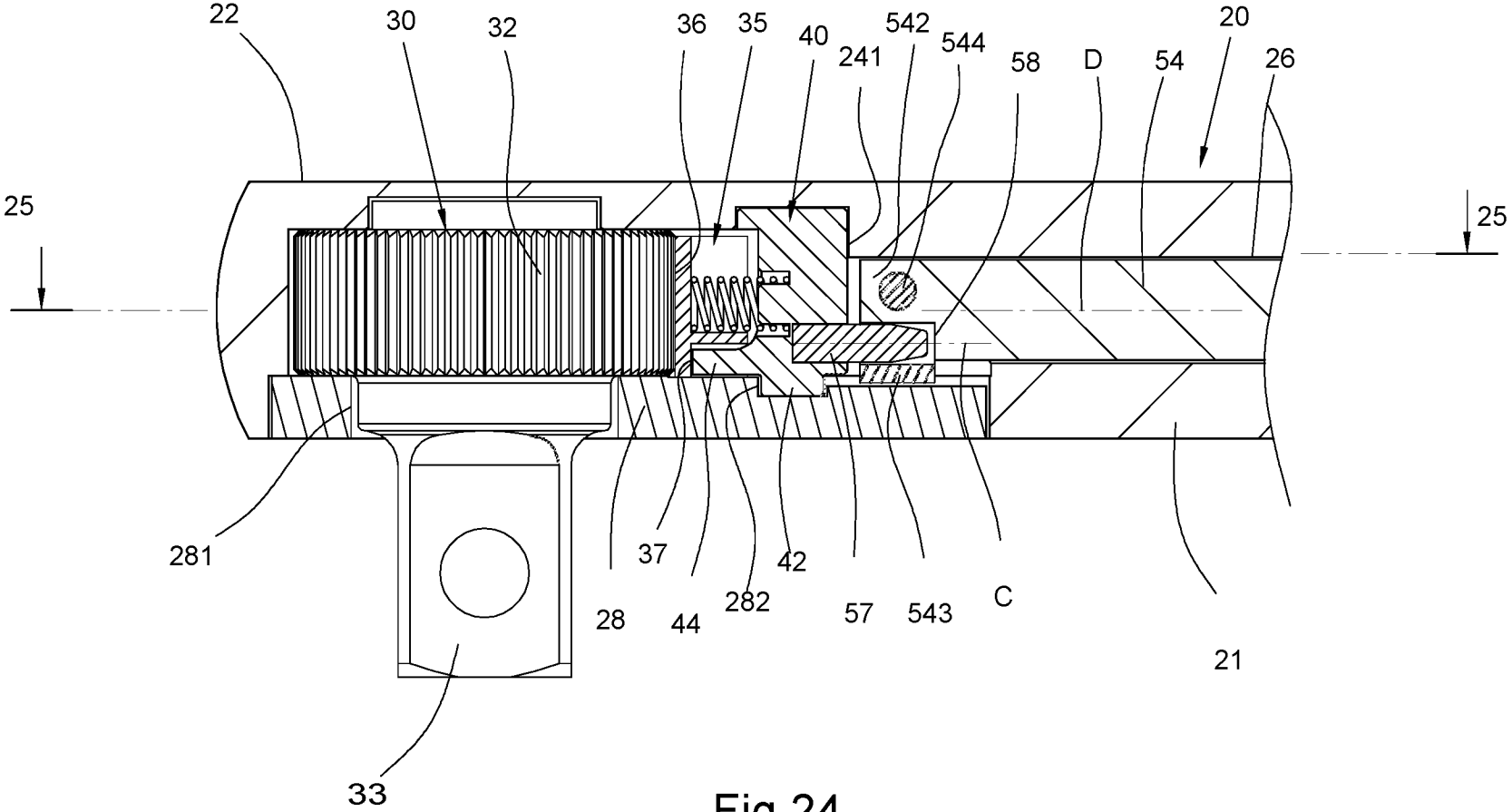
FIG. 24 is a partial assembled longitudinal sectional view of the wrench in FIG. 23.
Figure 25:
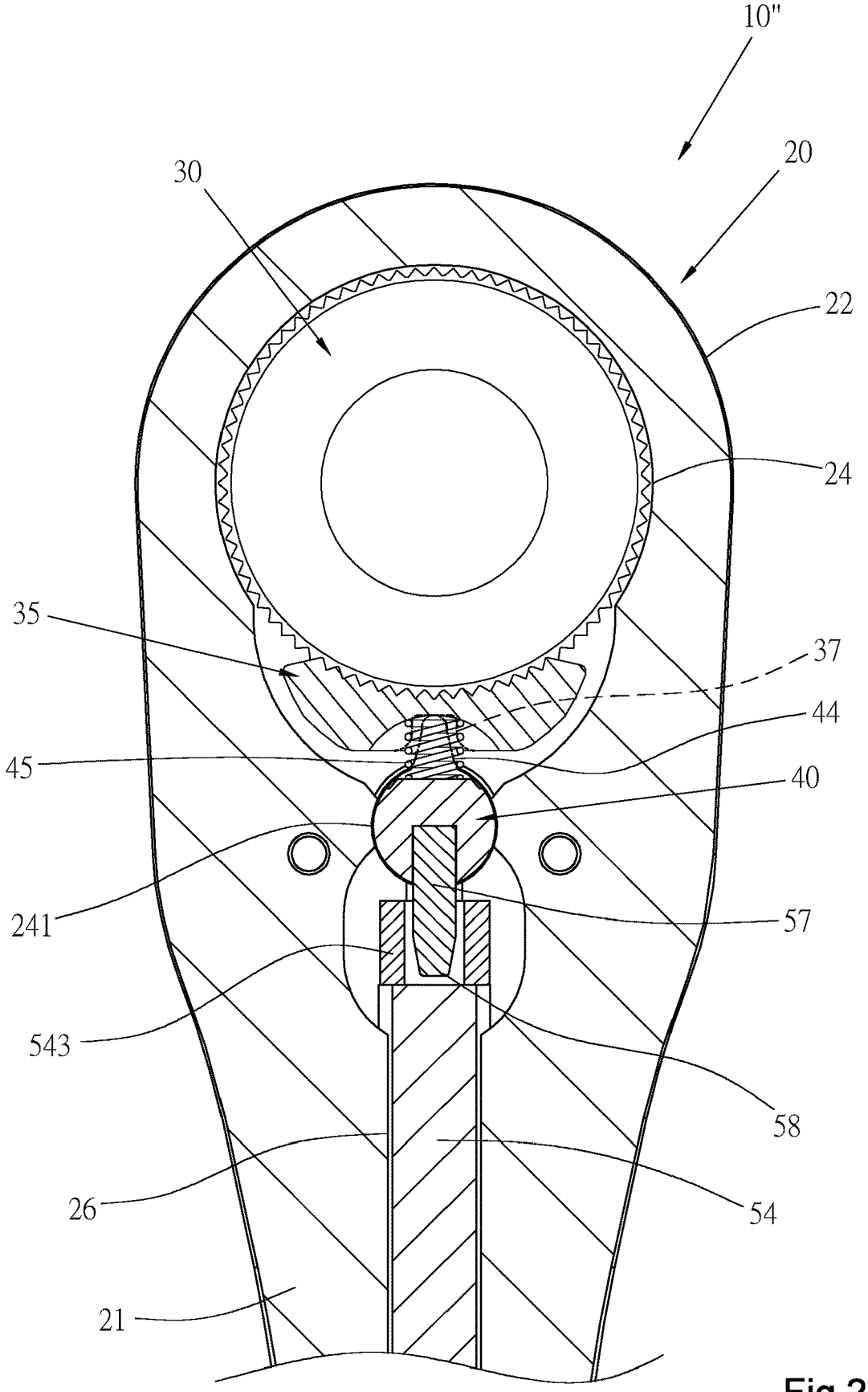
FIG. 25 is a sectional view taken along line 25-25 in FIG. 24.

FIG. 23 to FIG. 25 show the ratchet wrench 10" according to the third preferred embodiment of the present invention. Like the ratchet wrench 10 in the first preferred embodiment, the ratchet wrench 10" includes the main body 20, the ratchet gear 30, the pawl 35, the sideways pushing member 40, the elastic member 45, the direction changing device 50, the engaging member 57, and the engaging groove 58. The same components in the first and the third preferred embodiments are indicated by the same reference numeral, and the structural features of those components can be understood by referring back to the description of the first preferred embodiment and therefore will not be described repeatedly.

The third preferred embodiment is different from the first preferred embodiment in that the front end of the rotating rod 54 is provided with a protruding portion 542 whose diameter is smaller than that of the rotating rod 54, and that a U-shaped joining member 543 is provided whose two spaced-apart ribs are connected to the protruding portion 542 in a sandwich configuration, with a pin 544 extending through the ribs and the protruding portion to hold them together. The gap between the joining member 543 and the protruding portion 542 forms the engaging groove 58, and the rear end (the free end) of the engaging member 57 is engaged in the engaging groove 58. As shown in FIG. 24, the rear end (the free end) of the engaging member 57 is offset from the central axis D of the rotating rod 54.

The wrench 10" according to this preferred embodiment has the same operation method as in the first preferred embodiment. Pushing the sideways pushing button 52 sideways will drive the rotating rod 54 into rotation, and thanks to the cooperation between the engaging groove 58 and the engaging member 57, the sideways pushing member 40 will be rotated as a result and move the pawl 35 to the right or the left to change the one-way rotation direction of the ratchet gear 30 of the wrench 10".

The present invention places the operating portion of the direction changing device on the shaft 21 to facilitate operation of the direction changing device. In the preferred embodiment shown in FIG. 1, the sideways pushing button 52 of the direction changing device 50 is adjacent to the gripping end (the handle) of the wrench so that a user can change the rotation direction of the ratchet gear 30 by pushing the sideways pushing button 52 with the same hand that is used to hold the handle 23; in other words, the rotation direction of the ratchet gear can be controlled single-handedly, which provides convenience of operation.

Furthermore, as the sideways pushing button of the direction changing device is located at or adjacent to the handle, one who is using the wrench in a narrow space and wishes to switch the rotation direction of the ratchet gear can directly push the sideways pushing button 52 while keeping the head portion 22 of the wrench and the threaded fastener to be rotated (e.g., a bolt or nut) in the coupled state, and the wrench can be operated immediately after the rotation direction is switched. Thus, the aforementioned drawback of the prior art, i.e., a user in the same case will have to move the wrench out of the narrow space and, after switching the rotation direction, reinsert the wrench into the narrow space and recouple the head portion of the wrench to the threaded fastener, is overcome. The wrench of the present invention allows the rotation direction of the ratchet gear to be easily switched in a narrow space to achieve higher operation efficiency than the prior art.

The embodiments described above serve only to expound the features of the present invention but not to limit the scope of the invention. All equivalent modifications based on the disclosure of this specification and the appended claims shall fall within the scope of the patent protection sought by the applicant.

What is claimed is:

1. A ratchet wrench allowing easy change of rotation direction, comprising:

a main body having a shaft and a head portion provided at a front end of the shaft, wherein the shaft includes a gripping end formed at a rear end of the shaft, a receiving chamber is provided in the head portion, a channel is provided in the shaft along a longitudinal direction of the main body, the channel has a front end connected to the receiving chamber, and an open groove is provided in the shaft and in communication with the channel;

a ratchet gear and a pawl, both mounted in the receiving chamber of the head portion, wherein the ratchet gear is rotatable in the receiving chamber, the pawl is displaceable in the receiving chamber, and the pawl has a front end face meshing with a periphery of the ratchet gear;

a sideways pushing member rotatably mounted in the receiving chamber and located behind the pawl, wherein the sideways pushing member having an insertion hole is configured to drive the pawl into displacement when rotated, and an elastic member is provided between the sideways pushing member and the pawl and applies an elastic force to keep the pawl meshing elastically with the ratchet gear; and a direction changing device having a sideways pushing button, a rotating rod, an engaging member, and an engaging groove configured on the rotating rod to work with the engaging member;

wherein the rotating rod is mounted in the channel of the main body, is rotatable in the channel, has a front end aligned with the sideways pushing member, and has a rear end at the open groove;

the sideways pushing button is connected to the rotating rod through the open groove and is configured to drive the rotating rod into clockwise or counterclockwise rotation;

the engaging member is provided at one of a rear end face of the sideways pushing member and a front end face of the rotating rod, the engaging groove is provided at the other of the rear end face of the sideways pushing member and the front end face of the rotating rod, the engaging member has one end defined as a free end, movably engages the engaging groove, and is inserted into the insertion hole, the rotating rod has a central axis, a center of the free end of the engaging member is offset from the central axis of the rotating rod, and the rotating rod is configured to move the sideways pushing member in different directions and thereby displace the pawl toward two opposite lateral sides of the receiving chamber when rotated in different directions respectively, and a direction of displacement of the ratchet gear is changed when the rotating rods rotates, causing the engaging member to move inside the engaging groove, thus pushing the sideways pushing member to rotate, and the pawl to displace from a center of the receiving chamber to a side thereof.

2. The ratchet wrench of claim 1, wherein the engaging member is shaped as a straight rod, has a central axis, and has an opposite end defined as a connecting end and connected to one of the rear end face of the sideways pushing member and the front end face of the rotating rod, the engaging groove is provided in the other of the rear end face of the sideways pushing member and the front end face of the rotating rod, and the central axis of the engaging member and the central axis of the rotating rod are offset from each other in a longitudinal direction of the engaging groove.

3. The ratchet wrench of claim 1, wherein the sideways pushing button is configured to be secured at a first position along with the rotating rod when driving the rotating rod to rotate clockwise, and the sideways pushing button is configured to be secured at a second position along with the rotating rod when driving the rotating rod to rotate counterclockwise.

4. The ratchet wrench of claim 3, wherein a first positioning portion and a second positioning portion are provided at one of a peripheral wall of the channel and the rotating rod, at least one elastic positioning element is provided at the other of the peripheral wall of the channel and the rotating rod, the elastic positioning element is elastically coupled with the first positioning portion when the sideways pushing button and the rotating rod are secured at the first position, and the elastic positioning element is elastically coupled with the second positioning portion when the sideways pushing button and the rotating rod are secured at the second position.

5. The ratchet wrench of claim 4, wherein the first positioning portion and the second positioning portion are provided at the peripheral wall of the channel, a diametric hole is provided in the rotating rod along a diameter thereof, and the elastic positioning element is mounted in the diametric hole and is configured to be moved into the diametric hole or jut out of the rotating rod elastically.

6. The ratchet wrench of claim 1, wherein the open groove is provided in the shaft along a circumference thereof and is located either at the gripping end or not at the gripping end, and a connecting member extends through the open groove and has two ends connected respectively to the sideways pushing button and the rotating rod.

7. The ratchet wrench of claim 6, wherein the sideways pushing button has an annular shape and is provided around the shaft.

8. The ratchet wrench of claim 1, wherein an opening is provided at a top side or a bottom side of the head portion and is in communication with the receiving chamber, a sealing cover seals the opening, a shaft portion is provided at one end of the sideways pushing member, a pivot hole is provided in the sealing cover, and the shaft portion is pivotally provided in the pivot hole.

9. The ratchet wrench of claim 1, wherein a handle is provided at the rear end of the shaft, and the open groove is provided between the rear end of the shaft and a front end of the handle.

10. The ratchet wrench of claim 7, wherein the shaft has a periphery provided with an annular groove, and the sideways pushing button has an end edge extending into the annular groove.

* * * * *